US005711372A

United States Patent [19]

Stokley

[11] Patent Number: 5,711,372

[45] Date of Patent: Jan. 27, 1998

[54] INFLATABLE PACKER WITH PORT COLLAR VALVING AND METHOD OF SETTING

[75] Inventor: Charles O. Stokley, Houston, Tex.

[73] Assignee: TAM International, Houston, Tex.

[21] Appl. No.: 651,966

[22] Filed: May 21, 1996

[51] Int. Cl.[6] ..... E21B 23/06; E21B 31/127

[52] U.S. Cl. ..... 166/187; 166/332.4

[58] Field of Search ..... 166/187, 188, 166/387, 332.4

[56] References Cited

U.S. PATENT DOCUMENTS

| | | | |
|---|---|---|---|
| 2,435,016 | 1/1948 | Pitts | 166/154 |
| 2,659,438 | 11/1953 | Schnitter | 166/154 |
| 3,464,493 | 9/1969 | Chancellor et al. | 166/285 |
| 3,948,322 | 4/1976 | Baker | 166/289 |
| 4,254,832 | 3/1981 | Patton et al. | 166/332.4 |
| 4,499,947 | 2/1985 | Zsoka et al. | 166/179 |
| 5,024,273 | 6/1991 | Coone et al. | 166/289 |
| 5,109,925 | 5/1992 | Stepp et al. | 166/184 |
| 5,314,015 | 5/1994 | Streich et al. | 166/184 |
| 5,383,520 | 1/1995 | Tucker et al. | 166/142 |
| 5,400,855 | 3/1995 | Stepp et al. | 166/151 |
| 5,488,994 | 2/1996 | Laurel et al. | 166/387 |

*Primary Examiner*—David J. Bagnell
*Attorney, Agent, or Firm*—Browning Bushman

[57] ABSTRACT

An inflatable packer 10 includes a sliding collar 86 which opens and closes port 94 to control pressurization of the inflatable packer element 120 with a cementatious fluid. The collar 86 is axially moveable by a setting tool 20 suspended in the well from a work string WS. An annular passageway 76 in the packer body extends from the inlet port 94 to the packer element 120 to provide for reliable inflation with the cementatious fluid. The collar 86 provides metal-to-metal sealing engagement with the radially inner sleeve 76 of the packer body to reliably seal the inflation chamber from the well fluids when the collar 86 is moved closed.

21 Claims, 2 Drawing Sheets

INFLATABLE PACKER WITH PORT COLLAR VALVING AND METHOD OF SETTING

FIELD OF THE INVENTION

The present invention relates to an inflatable packer and particularly to an inflatable packer with a large flow path capable of transmitting a cement or epoxy to an inflation chamber to inflate the elastomeric packer element. The invention also relates to an improved technique for activating an inflatable packer utilizing mechanically transmitted forces to open a port collar valve for inflating the packer. Multiple packers can be reliably inflated in a single trip, and drill out of plugs is avoided.

BACKGROUND OF THE INVENTION

Various techniques have been proposed for placing cement in an annulus between downhole tubulars in order to seal between different zones otherwise in fluid communication with the same annulus. In some applications, the placement of a cement plug in the annulus may be completed by pumping cement downhole and opening a valve to pump the cement directly into the annulus. In highly inclined (non-vertical) wells, gravity tends to cause the pumped cement to fill the bottom of the annulus, and a reliable seal between the tubulars is typically not effected in the top of the annulus. Since reliable placement of cement may be significantly affected by gravity, this technique is not typically utilized in highly deviated or horizontal wellbores. U.S. Pat. Nos. 2,435,016, 2,659,438, and 3,464,493 each disclose downhole valves for pumping cement into an annulus about a tubular. U.S. Pat. No. 2,435,016 discloses a technique capable of multiple stage cementing. U.S. Pat. No. 3,464,453 discloses a port collar for a well casing to pack a wellbore with cement.

In order to achieve a more reliable seal in the annulus between downhole tubulars, cement has been used to inflate a packer for sealing this annulus. The elastomeric packer element acts as an initial seal between the tubular on which it is positioned and the surrounding tubular or the wall of an open hole. An inflation chamber radially inward of the elastomeric packer element serves as a receptacle for the cement or epoxy, which acts as the inflation fluid. Corrosive fluids are commonly contained in the flow stream of hydrocarbon recovery wells and thus result in the potential failure of the sealing function of the elastomeric packer element over an extended period of time. Cement or epoxy, once hardened within the inflation chamber, thus creates a permanent annular plug between the tubular on which the packer is positioned and the surrounding tubular or open hole. U.S. Pat. No. 5,488,944 discloses an inflatable packer which utilizes a chemical accelerating agent for hardening the cement used to inflate the packer element.

Conventional inflatable packers have valves to inflate the elastomeric packer element positioned within small diameter ports passing through the sidewall in the packer body and to the inflation chamber. Although these packers have been used for cementing operations, the small diameter ports and associated valving tend to plug with particles commonly carried by the cement slurry. Accordingly, packers especially designed for cement plugging operations may use an annular passageway between a radially inner sleeve and a radially outer sleeve to reliably transmit the cement or epoxy to inflate the packer element. U.S. Pat. No. 3,948,322 discloses a multiple stage packer with a sliding sleeve and an annular passageway for transmitting cement to inflate the packer element. U.S. Pat. No. 4,499,947 discloses an inflatable packer with both first and second sleeves for controlling inflation of the packer element. U.S. Pat. No. 5,024,273 discloses a complex tool with a stage collar for inflating the packer. U.S. Pat. No. 5,109,925 discloses a multiple stage inflation packer with a rupture disk. U.S. Pat. Nos. 5,314,015, 5,315,662 and 5,400,855 each disclose inflation packers with multiple sleeves, valves, and/or rupture disks. U.S. Pat. No. 5,383,250 discloses an inflation packer adapted for coiled tubing operations.

The above-described inflatable packers are complex and thus expensive. Multiple sleeves, rupture disks, and/or other valves increase the complexity of the inflatable packer and generally reduce the flow capacity. Long term reliability of the set packer may be questionable since corrosive fluids and/or high temperature fluids may attack the elastomeric seals which seals the ends of the packer inflation chamber. If these elastomeric seals fail prior to curing the cement, a leak path past the cement plug may be formed, although that leak path may not be detectable until after the packer has been set and the hydrocarbon recovery system is brought into operation. Other inflatable packers cannot pressure test the seals to ensure that the packer chamber is reliably sealed with the cementatious inflation fluid.

A significant disadvantage of prior art inflatable packers of the type intended for inflation with a cementations fluid is that the valving to the inflation chamber is hydraulically activated. A plug or a ball is typically dropped from the surface for sealing engagement with a seat, after which a cement slurry is transmitted to the packer inflation chamber, followed by another plug or ball. Fluid pressure in the well is thus increased to open the valve to the inflation chamber, thereby allowing the cement slurry to inflate the sealing element. While plugs or balls have long been used to set inflatable packers, the reliability of the setting operation is particularly suspect when the packer is used in highly deviated or horizontal wellbores, since gravity does not assist in controlled movement of the plug and since plugs do not reliably flow past corners or sharp deviations in a deviated well.

After the cement has cured or after another valve of the inflatable packer has been closed, the cement still within and above the bore of the packer is drilled out, along with the plugs or balls, thereby re-establishing a full bore through the set packer. Even if the quantity of cement may be precisely controlled to fully inflate the packer without excess cement being in the bore, the plugs or balls still must be removed to establish full bore capability. With any drill out operation, and most commonly with operations involving highly deviated or horizontal boreholes, there is a risk that the drill bit may inadvertently penetrate the casing, thereby causing significant repair costs and down time.

In other applications, it would be desirable to set the packer in a well along a casing string which includes perforations or slots in the casing above the packer. These perforations or slots need to be closed off or a bypass placed around the perforations or slots within the casing for the hydraulically set packer to be filled with cement or other inflation fluid. As a practical matter, the cost of temporarily closing off or bypassing the perforations or slots are so high that inflatable set packers are not frequently used in casing strings which include the slots or perforations.

Another significant disadvantage of prior art inflatable packers is that multiple packers cannot be placed along a casing string and each packer reliably activated hydraulically to open a valve and inflate the sealing element with cement or another inflation fluid. Wiper plugs positioned below and above the cement column are sized for sealing engagement with an inflatable packer. As a practical matter, however, it is difficult if not impossible to ensure that a wiper plug will properly seat with its desired packer but will not inadvertently cause the activation of other packers through which the plug passes while flowing down to its desired packer seat. While different size plugs may be used, the plugs conventionally seal with the casing to prevent the escape of cement from the column as it is pumped downhole to the desired packer. As a practical matter, therefore, casing strings which include inflatable packers typically cannot reliably inflate more than two hydraulically set packers within the casing ming and reliably ensure that the wiper plugs do not inadvertently cause the opening of an unintended packer positioned along the casing string. If the valve is inadvertently opened by a wiper plug and cement is unintentionally pumped into the inflated packer, the operator at the surface may not realize that the wrong packer in the casing string has been inflated until after the cement hardens. Accordingly, an expensive mill out operation may be required to cure the problem caused by the inadvertent hydraulic setting of an inflation packer.

The disadvantages of the prior art are overcome by the present invention, and an improved inflatable packer is hereinafter disclosed which is particularly well suited for inflation with cement or an epoxy to form a permanent plug in a wellbore. The techniques of the present invention allow for the reliable setting of multiple inflatable packers within a casing string, and avoid significant problems involving drill out of plugs.

SUMMARY OF THE INVENTION

The inflatable packer of the present invention preferably includes a single valve collar which is opened and closed by forces mechanically transmitted from the surface to the packer, thereby inflating then subsequently closing off the packer inflation chamber. Mechanical forces may be transmitted through a work string and a setting tool to open and close the collar. The sliding collar includes a flange or other stop member for locked engagement with the setting tool. The work string may be slacked off to lower the collar and open a large port for transmitting cement from the work string to the packer inflation chamber. After setting the packer, the work string may be pulled up for returning the collar to its upward position while making up a metal-to-metal seal both above and below the port and between the collar and the packer body, thereby ensuring that corrosive fluids are sealed from the inflation chamber. Fluid pressure may subsequently be increased in the annulus between the work string and the casing to reverse circulate the cement slurry back to the surface through the work string. Accordingly, expensive and time-consuming drill out operations are avoided. By avoiding plug drill out operations, inadvertently drilling through the casing string during drill out is eliminated.

Since the valve for controlling opening and closing of the inflation chamber is mechanically activated, multiple packers positioned along the casing string may each be selectively activated at any time. The setting tool includes a profile for engagement with the collar of the inflatable packer to be actuated, although the tool may be easily raised or lowered past one or more similar inflatable packers then positioned at a desired setting for engagement with the desired inflatable packer to activate that packer. Multiple packers may thus be reliably set with the same setting tool in a single trip of the work string. The packer setting operation may also be used to activate packers positioned along a casing string with perforations or slots in the casing string, since the inflation fluid is transmitted to the packer through a work string rather than through the casing string.

The integrity of the seals above and below the port in the packer body may be pressure tested once the collar is closed and, if necessary, the collar may be reclosed until reliable seals are made up. The make up of metal-to-metal seals between the collar and the packer body ensures that corrosive fluids will not enter the sealing chamber, and allows the packer to be reliably used in high temperature applications.

It is an object of the present invention to provide an inflatable packer adapted for pumping a cementations fluid into the inflation chamber whereby the casing string on which the packer is positioned may be opened to full bore without drill out of plugs used in the inflation operation. The packer is well adapted for use in highly deviated and horizontal bore holes which cannot reliably transmit plugs to the packer. The risk of inadvertent drilling a hole in the casing is eliminated by avoiding the plug drill out operation. The packer of the present invention includes a valve collar which may be reliably operated for opening and closing even when the packer is used in a downhole environment wherein the casing string and/or the packer is subject to high bending loads which are commonly encountered in highly deviated or horizontal wells.

It is another object of the invention to provide an inflatable packer of the type wherein the inflation chamber may be sealed by mechanically opening and closing a valve collar. Multiple packers may be positioned along the casing string and each packer selectively inflated by manipulating a running tool in a single trip of the work string. Inflation fluid is transmitted to the packer through the work string, so that the packer may be reliably set in a casing string with slots or perforations above the packer.

It is a feature of this invention that the inflatable packer includes a single valve collar which is mechanically opened and closed with sliding movement, thereby reducing the complexity of the tool. When the collar is moved closed, the seal between the collar and the packer body may be pressure tested to ensure reliable sealing engagement.

Still another feature of this invention is that the opened collar may expose a plurality of large ports for transmitting cementations fluid to an annular passageway extending axially from the collar to the inflation chamber.

Yet another feature of this invention is that the sliding collar includes a metal-to-metal seal so that the packer may be used in high temperature applications with the inflation chamber remaining sealed from the downhole fluids. The metal-to-metal seals significantly reduce or eliminate the effects of corrosive well fluid which deteriorate seals normally provided in packers for sealing the inflatable chamber. Long term reliable operation of the packer is enhanced by providing metal-to-metal seals between the sliding collar and the packer body.

An advantage of the inflatable packer according to the present invention is that the packer may be reliably used in applications wherein elastomeric seals are prohibited for downhole tools. The packer according to the present invention includes metal-to-metal seals for sealing between the sliding collar and the packer body, with elastomeric seals optionally providing redundant sealing effectiveness and preferably being positioned upstream from the metal-to-metal seals.

Another advantage of the present invention is that the metal-to-metal seals between the sliding collar and the packer body may be formed by slacking off the work string and subsequently pulling upward with a large axial force on the work string to jerk the collar upward into sealing engagement with tapered metal sealing surfaces on the packer body. By providing a low angle engagement surface between the metal collar and the metal packer body and by supplying a sufficient axial force to the work string, the likelihood of the sealed collar subsequently inadvertently dropping to an open position is eliminated or substantially reduced.

These and further objects, features, and advantages of the present invention will become apparent from the following detailed description, wherein reference is made to the figures in the accompanying drawings.

DETAILED DESCRIPTION OF THE PREFERRED EMBODIMENTS

FIG. 1 depicts an exemplary application for the present invention. Inflatable packers are commonly used in hydrocarbon recovery operations for isolating geological zones. A borehole B may be drilled through an upper hydrocarbon zone UHZ, through a non-hydrocarbon bearing shale zone SZ, and then through a lower hydrocarbon zone LHZ. The inflatable packer may thus be used to isolate these zones and thereby maximize recovery of hydrocarbons. Although FIG. 1 depicts the wellbore B as being vertical, those skilled in the art will appreciate that the inflatable packer of the present invention is particularly well suited for use in highly deviated and horizontal boreholes. In those applications, the borehole may still traverse geological zones, and the inflatable packer may be used to fluidly isolate zones from each other. Highly inclined or horizontal wellbores thus typically pass through various permeable layers which contain hydrocarbons, with the permeable layers being separated by impermeable layers which typically include shale or granite. The hydrocarbon producing layers are fluidly isolated in order to selectively produce the hydrocarbons. According to the method of the invention, this isolation is achieved by using an inflatable packer to seal between the outside of the casing C and the open borehole B. In order to achieve long term sealing effectiveness, the inflatable chamber of the packer may be filled with a cementatious fluid.

Figure 1A:
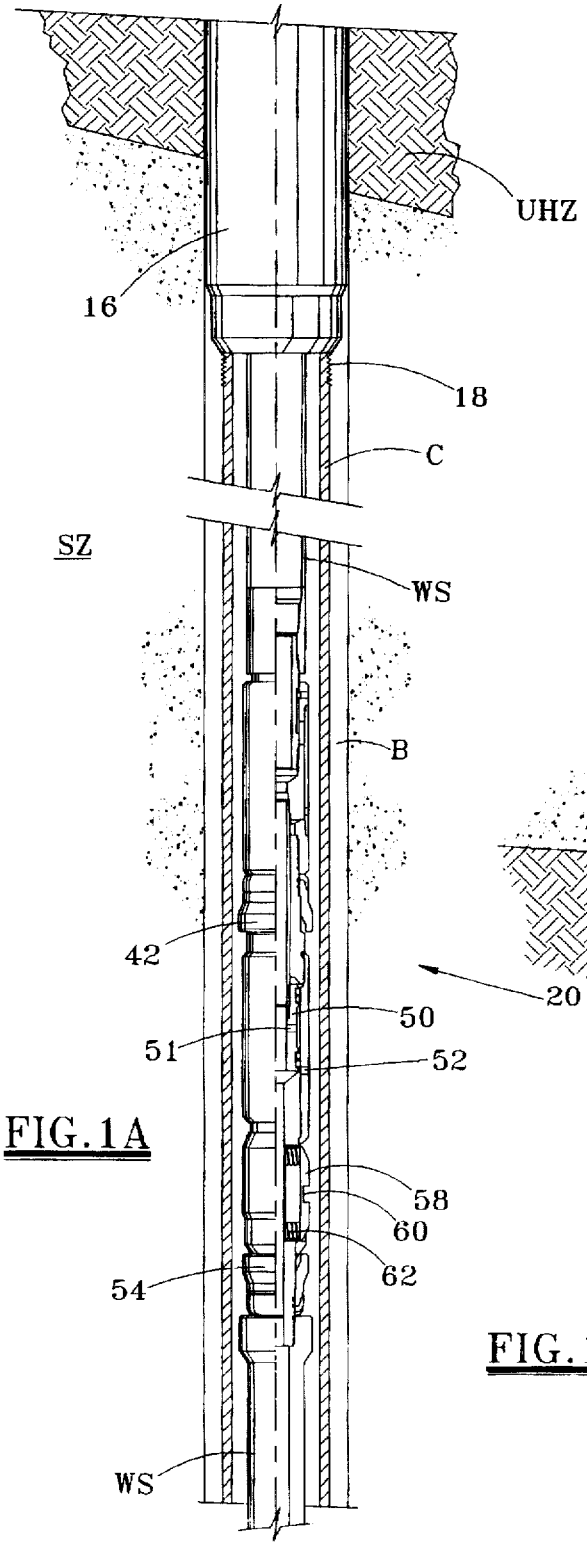
FIG. 1A is a pictorial view of a well including a casing string with a lower portion of an upper packer positioned thereon and with a work string passing through the upper packer. Positioned below the upper packer is an actuating tool for operating a lower packer positioned on the casing string below the actuating tool.

FIG. 1A depicts the lower end of an inflatable packer positioned along a casing string C and borehole B. The packer 16 is shown in its inflated position so that the annulus between the casing C and the borehole wall is plugged by the set packer 16. For this exemplary embodiment, the fluid used to inflate the packer is a cementatious fluid which is a slurry when pumped into the packer, and hardens to form a permanent plug. The term "cementatious fluid" as used herein refers to any type of slurry which may be used in downhole operations to form a plug, including compositions such as a cement slurry, a curable polymer or plastic, or an epoxy. As shown in FIG. 1A, the inflatable packer 16 thus isolates the UHZ from the SZ. Packer 16 may be identical in construction and operation to the inflatable packer 10 discussed below and generally shown in FIG. 1B.

Figure 1B:
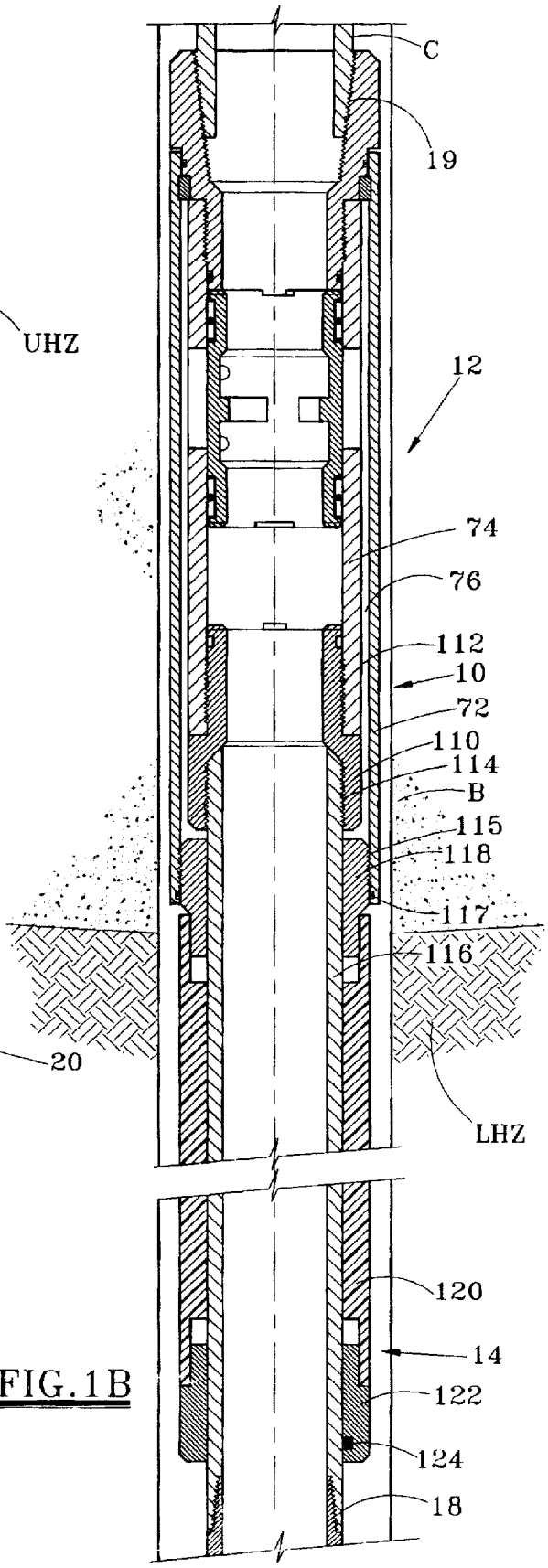
FIG. 1B generally illustrates a lower packer according to the present invention adapted for being inflated with a cementations fluid in the work string shown in FIG. 1A.

The lower end of the packer 16 is interconnected with the casing C by conventional threads 18. The casing C extends through the SZ, and supports another inflatable packer 10 positioned in the well (see FIG. 1B) so that the inflatable packer element 120 is generally at the interface between the SZ and the LHZ. Those skilled in the art will appreciate that numerous inflatable packers may be positioned along a casing string in a wellbore, and that only two packers are shown in FIG. 1 for simplicity. The packers of the present invention are designed such that a number of packers may be positioned axially at selected locations along a casing string, and each packer may be selectively inflated as described hereafter. Also, those skilled in the art should appreciate that the term "casing" or "casing string" as used herein refers to any tubular member of the type which may be positioned downhole for supporting an inflatable packer.

Referring to FIG. 1B, the inflatable packer 10 is shown in its run-in or deflated position. Packer 10 comprises an upper body 12 which is discussed subsequently and supports the valve collar, and a lower body 14 which includes an elongate elastomeric packer element 120 which inflates in a conventional manner. The upper body 12 of the packer is thus connected to the casing C by threads 19, and the lower body 14 is similarly interconnected with casing C by threads 18. The term "elastomeric packer element" or "packer element" as used herein refers to any type of generally tubular bladder which may be inflated during actuation of the packer. Elastomeric packer elements are well known in the art, and numerous such packer elements are generally disclosed in the prior art discussed earlier.

FIG. 1A also depicts a work string WS positioned within the casing C and passing through the throughbore in the packer 16. The term "work string" as used herein refers to any type of tubular string conventionally used to mechanically set downhole tools, including tubing strings interconnected by threaded connections or coiled tubing. Secured to the work string WS is a actuation tool 20 which as depicted is positioned below the packer 16. The work string WS may also extend below the actuating tool 20, and includes an internal bore or flow path which is sealed from the interior of the casing string C. Those skilled in the art will appreciate that the work string WS may be lowered so that the tool 20 is positioned for activating the packer 10 as discussed subsequently. Actuating tools 20 are well known in the art and accordingly details regarding the actuating tool 20 are not discussed herein. A suitable actuating tool 20 according to the present invention for activating an inflatable packer is the TAM Combination Tool.

Internal to the body of the inflatable packer 10 is a collar 86 which is movable along the axis of the packer to allow exposure of a port from the interior of the casing to the inflation chamber radially within the expandable packer element. Fixed tubes create an annular passageway 76 for flow of the inflation fluid from the port into the inflation chamber. The inflatable element 120 is attached to the outer tube, while the casing is attached to the inner tube for supporting the tensile loads transmitted through the packer. A sub 122 is attached to a lower end of the inflatable element to provide an outer seal with the casing at the lower end of the inflation chamber.

The collar 86 as disclosed herein is a sliding sleeve which is opened and closed with an axial motion transmitted to the sleeve by the setting tool. Referring again to FIG. 1A, the setting tool 20 includes dual opposing seal cups 42 and 54 and contains spring-loaded dogs 58 for opening and closing the collar. The setting tool 20 also contains an internal bypass to facilitate running in and out of the hole. A shear choke sub may be incorporated in the setting tool for quick filling of the work string and dumping the work string fluid when the packer inflation job is complete.

The valve collar may alternatively be opened and closed by torque transmitted to the collar through the setting tool. The collar may thus be opened with left-hand torque and closed with right-hand torque transmitted through the work string WS. The collar includes slots to receive spring-loaded dogs on the setting tool to provide a positive indication that the setting tool has landed in the collar. The setting tool will not pass through the collar while the dogs are engaged. Multiple packers can thus be run on one casing string and each packer selectively opened and closed in a single trip of the work string and the setting tool.

Figure 2:
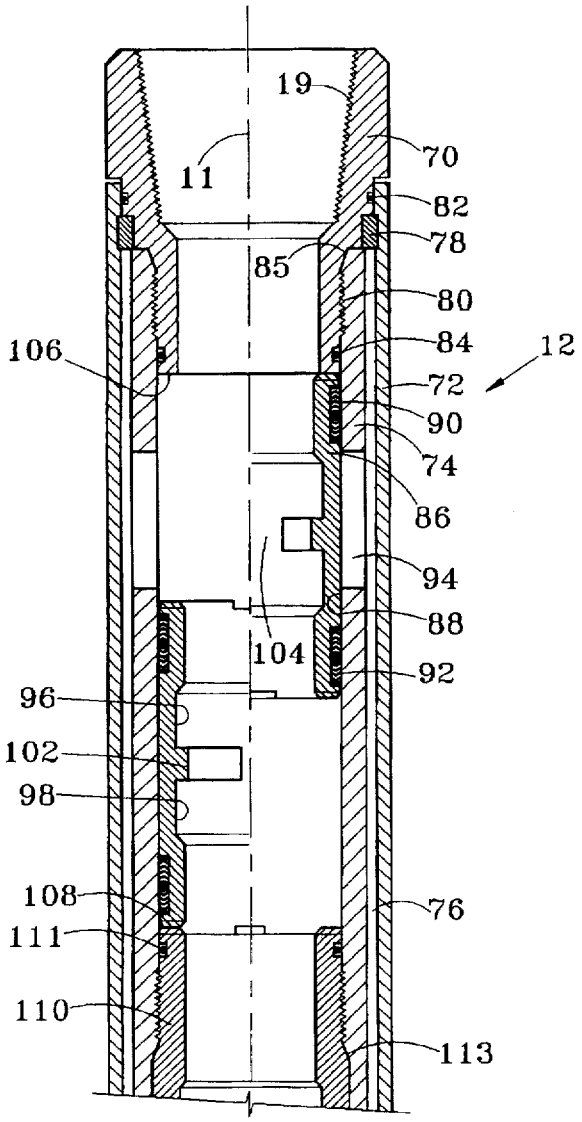
FIG. 2 is a detailed cross-sectional view of a portion of the inflatable packer generally shown in FIG. 1B. The collar on the right side of the centerline in FIG. 2 is shown in the closed position, and the collar on the left side of the centerline is shown in the opened position.

Referring now to FIG. 2, the upper body 12 is depicted with the components on the right side of the centerline 11 in the valve closed or run-in position, and the components on the left side of the centerline 11 shown in the valve open or inflated position. The upper sub 70 of the packer 10 includes conventional threads 19 for threaded engagement with the casing C. An outer tube 72 extends downwardly from the sub 70 and may be interconnected therewith by threads, keys or other conventional securing members 78. An inner tube 74 also generally extends downwardly from the sub 70, and is interconnected therewith by threads or other conventional securing members 80. The outer tube 72 is sealed to the sub 70 by o-ring seal 82, which prevents well fluids in the borehole B from communication with the interior of the packer 10. O-ring seal 84 and metal-to-metal seal 85 similarly seal between the sub 70 and the inner tube 74. As shown in FIG. 2, an elongate annulus 76 is thus formed between the outer diameter of the tube 74 and the inner diameter of the tube 72. One or more circumferentially spaced radial ports 94 are provided within the inner tube 74. Ports 94 are normally blocked by the valve collar 86. When the valve collar 86 is open, as shown on the left side of FIG. 2, fluid from the work string WS may pass through one or more ports 94 and then through the annular passageway 76 to inflate the packer, as explained subsequently.

The valve collar 86 is a sleeve-shaped member which is axially moveable from the open position, as shown on the left side of FIG. 2, to the closed position, as shown on the right side of FIG. 2. The opening and closing of the valve collar 86 may be repeated as desired. When in the closed position, the upper end of the valve collar 86 may engage the stop surface 106 formed at the lower end of the sub 70. When in the fully opened position, the lower end of valve collar 86 may similarly engage the stop surface 108 on the sub 110. The valve collar includes an upper annular seal 90 for sealing engagement between the valve collar and the inner cylindrical surface 88 of the inner tube 74 and above the one or more ports 94. When the valve collar is in the closed position, a lower elastomeric annular seal 92 provides similar sealing engagement between the valve collar and the inner tube 74 at a position axially below the one or more ports 94. Various types of elastomeric sealing members may be used in the valve collar according to the present invention, including seals fabricated from rubber and plastics.

The valve collar 86 includes an annular upper recess 96 and an annular lower recess 98 with a circumferentially spaced projection 102 therebetween. As shown in FIG. 2, the projection 102 does not extend circumferentially fully around the valve collar, and instead one or more circumferential spacings 104 between projections 102 are provided. The projections 102 and the spacings 104 cooperate, as explained subsequently, so that the actuation tool may be mechanically interconnected to the valve collar 86, but also allow the actuation tool 20 to be rotated and moved axially past the valve collar 86 and through the inflatable packer 10 for actuating another inflatable packer positioned along the casing string C either above or below the packer 10.

The lower end 14 of the inflatable packer 10 is functionally equivalent to various types of inflatable packers, and accordingly is only generally shown in FIG. 1B. The lower end of the inner tube 74 is interconnected with the sub 110 by threads 112 or other conventional securing members. O-ring seal 111 and metal-to-metal seal 113 provide for reliable sealing between inner tube 74 and sub 110. The lower end of sub 110 is in threaded engagement with mandrel 116 which extends axially downward to a position below the elastomeric packer element 120. The lower end of the mandrel 116 includes conventional threads 18 for threaded engagement with the casing C. Accordingly, the sub 70, the inner tube 74, the sub 110, and the mandrel 116 provide a structural interconnection between the casing string above the packer 10 and the casing string below the packer 10.

The annular passageway 76 as shown in FIG. 2 thus continues downward between the sub 110 and the outer tube 72. This flow passageway then extends radially inward between the mandrel 116 and the upper packer sub 118, then into the inflation chamber between the packer element 120 and the mandrel 116. The upper packer sub 118 is threadably connected to the lower end of the outer tube 72 by conventional threads 115, and is sealed to the outer tube by an o-ring seal 117. For the embodiment as shown herein, the upper sub 118 is thus axially fixed with respect to the casing C. A lower packer sub 122 is provided at the lower end of the elastomeric packer element 120, and includes a seal 124 for dynamic sealing engagement with the outer surface of the mandrel 116. During inflation of the packer, the lower packer sub 122 may move axially upward toward the upper packer sub 118 to accommodate expansion of the elastomeric packer element 120. Cementatious fluid typically includes particles which tends to plug small valves or passageways with small diameters. Also, cementatious fluid which is pumped at high velocities through small valves and small diameter passageways corrodes the valves and passageway walls during the inflation process. These problems are thus avoided by providing one or more large diameter inlet ports 94 and an annular passageway 76 fluidly connecting the inlet ports 94 with the packer inflation chamber. According to the present invention, the flow through area of the one or more inlet ports 94 is at least 0.15 square inches, and preferably is at least 0.25 square inches. A cement slurry with solid particles will thus reliably pass through the inlet ports 94 and the annular passageway 76 and then to the packer inflation chamber without plugging the flow path.

When inflation packers are set by plugging operations as discussed above, the well operator may be unsure which packer is being inflated. According to the present invention, the actuating tool 20 at the end of work string WS is used to open and close the valve collar 86. Accordingly, the payout length of work string WS may be used to reliably determine which packer positioned along the casing string is being acted upon by the tool 20 to open and close the valve collar. If desired, a conventional locator sub may also be run in with the actuating tool 20 to further ensure the position of the tool 20 within the well and thus the reliable operation of the desired inflatable packer.

The actuating tool 20 includes one or more locking dogs 58 which are biased radially outward by springs 62. The dogs 58 may thus move radially relative to the actuator body, and together define an exterior profile for locked engagement with the valve collar 86. The radially inward surface of the valve collar 86 thus includes spaced apart grooves 96 and 98 separated by a partial ring or flange 102 having upper and lower stop surfaces thereon. The dogs 58 thus fit within a respective groove 96, 98 to mate with the valve collar 86 so that axial forces may be reliably transmitted from the work string WS to a tool 20 and then to the valve collar 86 to open and close the collar. The spring biased dogs 58 also provide a positive indication that the tool 20 is mechanically interconnected with the valve collar. Separate upper and lower dogs may be provided, or upper and lower dogs on a unitary component 58 may be separated by groove 60 which fits within partial flange 102.

When a tool 20 is interconnected to the valve collar 86, the upper seal cups 42 and the lower seal cups 54 will sealingly engage the packer body. When the tool 20 is interconnected with the valve collar 86, the operator may slack off the work string WS, thereby allowing gravity and compressive loads (weight of the WS) to drop the tool 20 and thus simultaneously lower the valve collar 86 to the opened position and open the sliding valve 50 internal of actuator body so that ports 51 are in fluid communication with ports 52. Cementatious fluid from the bore in the work string WS may then be pumped through the work string WS so that the cementatious fluid flows through ports 51 in sliding valve 50 and through ports 52 in actuator body, then into the open port 94 in sleeve 74 and down the annular passageway 74 to inflate the packer element 120. Since fluid pressure is not required in the annulus between the work string WS and the casing C, this inflation operation may be accomplished even if the casing string above the packer is slotted or perforated.

Figure 3:
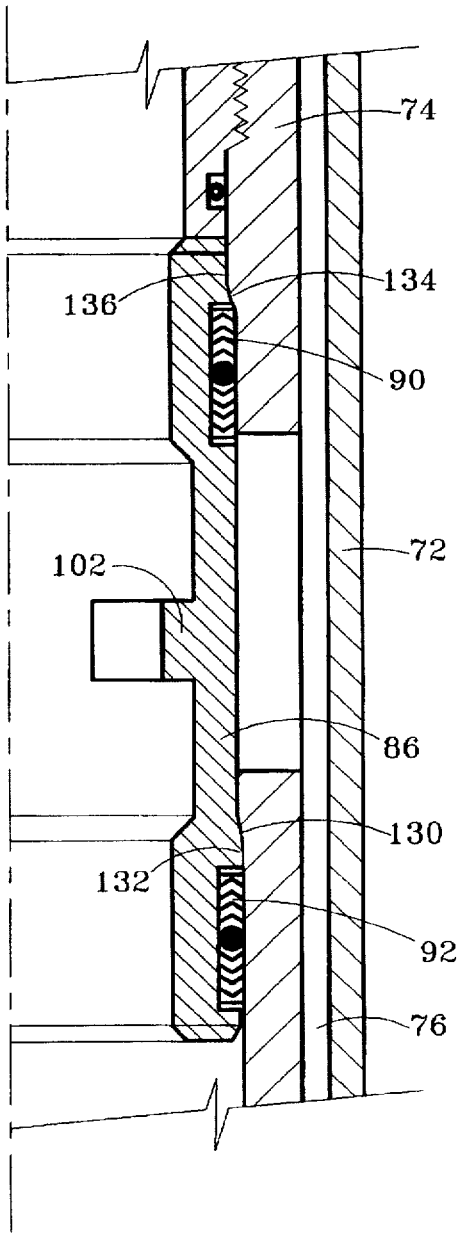
FIG. 3 is an enlarged cross-sectional view illustrating the metal-to-metal sealing engagement of the collar and the packer body when the collar is in the closed position.

Once the packer 10 is inflated, the operator may pull up on the work string WS, thereby raising the tool 20 and returning the valve collar 86 to the closed position. During this upward pull, a tensile applied to the work string WS will make up the metal-to-metal seals between the valve collar and the work string, as shown in FIG. 3. The packer body thus includes a tapered upper metal sealing surface 136 and a tapered lower metal sealing surface 132 each formed at a relatively low angle relative to the axis of the packer body. The valve collar 86 includes corresponding tapered upper and lower metal sealing surfaces 134 and 130. The sealing forces used to reliably make up the metal-to-metal seals may be controlled by regulating the upward pull on the work string WS and by maintaining a desired cam angle between the tapered metal-to-metal sealing surfaces.

After the operator pulls up on the work string WS to close the valve 86, fluid pressure may be increased on the bore of the work string WS to reliably test the integrity of the closed valve collar. If there is any leakage between the closed valve collar and the packer body, fluid pressure in the work string will slowly decrease. In that event, the operator may slack off the work string to at least partially open the valve collar 86, then again pull up on the work string with a higher tensile force to form a more effective metal-to-metal seal between the valve collar and the packer body. The relatively high forces transmitted through the work string to the valve collar when forming the metal-to-metal seal may result in a minimal amount of metal deformation or galling of these metal sealing surfaces. This galling is not undesirable, however, since this action may be used to practically ensure that the valve collar 86, once reliably closed, will not inadvertently thereafter open after the actuating tool 20 is moved to a new location in the well.

The use of metal-to-metal seals between the valve collar and the packer body is highly desirable for the long term reliability of the inflated packer to ensure that well fluids which normally deteriorate elastomeric seals cannot enter the interior of the inflation chamber. It should be understood, however, that elastomeric upper annular seal 90 and elastomeric lower annular seal 92 may also be provided for sealing between the valve collar and the packer body. These elastomeric seals provide for redundant sealing, and effectively prevent well fluids from initially contaminating the metal-to-metal sealing surfaces. Over an extended period of time and after the cementatious fluid in the set packer is cured, the well fluids may attack and effectively destroy the sealing effectiveness of the elastomeric seals. Well fluids passing by the elastomeric seals 90 and 92 will not be able to enter the inflation chamber, however, because the reliable metal-to-metal seals are provided fluidly downstream from the elastomeric seals.

As previously noted, the partial ring or flange 102 does not extend circumferentially completely about the valve collar. The spacing 104 between ring segments allows an operator to selectively engage the locking dogs 58 with the valve collar 86, or alternatively to pass the tool 20 vertically upward or downward past one inflatable packer for reliable actuation of either an upper or a lower inflatable packer. As previously indicated, the biased dogs 58 allow the well operator to reliably determine if the dogs 58 have locked onto a particular valve collar 86. If locking engagement between the dogs 58 and that valve collar is not desired, the operator may rotate the work string WS and thus the tool 20 and the locking dogs 58 so that the locking dogs 58 are circumferentially positioned in line with spacing 104. With the dogs 58 circumferentially aligned with the spacings 104, tool 20 may be easily passed by the valve collar of one inflatable packer and then repositioned for engagement with a similar valve collar of another inflatable packer positioned along the casing string. In this manner, any number of inflatable packers positioned along a casing string may be selectively actuated to open and close the inflation chambers with a single trip of the work string WS within the well.

Once a particular valve collar 86 is opened and cementatious fluid is pumped into the inflation chamber to inflate the desired packer, the valve collar 86 may then be mechanically returned to the closed position, as described above. Once closed, the operator may reliably remove excess cementatious fluid within the work string WS by a reverse circulating operation. During this process, fluid pressure is increased in the annulus between the work string WS and the casing C. This increased fluid pressure will enter the interior of the tool 20 (valve 50 is still open), thereby forcing the excess cementatious fluid in the bore of the work string WS upward to the surface. The excess cementatious fluid may thus be reverse circulated to the surface in a simple and reliable manner. Most importantly, drill out of plugs and excess cementatious fluid is not required. The high cost and numerous problems which conventionally accompany drill out operations may thus be avoided according to the technique of the present invention.

Various modifications to the inflatable packer and to the technique as described above may be made without departing from the concepts of the present invention. If desired, for example, an actuating tool may include dogs with a profile for mated engagement with only selected ones of various valve collars associated with inflatable packers positioned within a well, thereby ensuring that the actuating tool will always pass by a valve collar with a profile which is not intended for mating engagement with that actuating tool. The packer body on which the port collar is mounted may be provided with a locator sub for ensuring the position of the port collar and/or the packer within the well. While the present invention has particularly described for the application wherein the packer is inflated with a cementatious fluid which then cures and hardens within the well, those skilled in the art will appreciate that the concepts of the present invention may also be applied for inflating a packer with any type of inflation fluid.

In the embodiment discussed above, the valve collar 86 is positioned axially above the elastomeric packer element 120. The valve collar 86 could, however, be spaced axially below the packer element. As previously noted, the valve collar could also be opened and closed in response to rotation. Mechanical forces transmitted through the work string to an actuating tool may thus result in sufficient torque applied to the valve collar to open and close the valve collar. Axial forces transmitted through the work string to the actuating tool may still be used, if desired, to reliably make up a metal-to-metal seal between the valve collar and the packer body.

The port collar as disclosed herein may also be operated by an actuating tool to selectively pump a cementatious fluid from a work string through the casing and then into an annulus about the casing. The metal-to-metal seal as disclosed herein would then desirably be formed between the valve collar and a mandrel positioned along the casing string and supporting the port collar. In some applications, an inflatable packer will thus not be necessary to form a reliable downhole cementatious plug.

The foregoing disclosure and description of the invention is illustrative and explanatory thereof, and it will be appreciated by those skilled in the art that various changes in the size, shape and materials as well as in the details of the illustrated construction or combinations of features of the various inflatable packer elements and the method of actuating a packer and removing excess cementatious fluid from the interior of the work string WS discussed herein may be made without departing from the spirit of the invention.

What is claimed is:

1. An inflatable packer for positioning along a tubular string and for setting downhole in a wellbore, the inflatable packer comprising:

a sleeve-shaped packer body having an upper end adapted for interconnection with the tubular string, a lower end, and a central throughbore;

an elastomeric packer element radially outward of the packer body for expanded engagement into one of an inner surface of a large diameter tubular radially external to the tubular string and a wall of the wellbore, the elastomeric packer element and the sleeve-shaped packer body defining an inflation chamber radially therebetween;

a valve collar moveable relative to the packer body to selectively open and close fluid communication between the central throughbore and the inflation chamber, the valve collar having a stop surface thereon for mated engagement with an actuating tool suspended within the tubular string on a work string to open and close the valve collar by mechanical manipulation of the work string; and a seal for sealing between the valve collar and the packer body to seal the inflation chamber from the throughbore when the valve collar is moved closed.

2. An inflatable packer as defined in claim 1, where the packer body comprises:

a radially inner sleeve extending radially from the valve collar to the inflation chamber;

a radially outer sleeve extending radially from the valve collar to the inflation chamber; and an annular flow passageway between the radially inner sleeve and the radially outer sleeve for transmitting inflation fluid to the inflation chamber.

3. An inflatable packer as defined in claim 2, wherein the seal further comprises:

an upper annular metal-to-metal seal for sealing between the valve collar and the packer body when the valve collar is closed; and a lower annular metal-to-metal seal for sealing between the valve collar and the packer body when the valve collar is closed.

4. An inflatable packer as defined in claim 3, wherein the packer body includes a tapered upper sealing surface and a tapered lower sealing surface for sealing engagement with the valve collar to form the upper metal-to-metal seal and the lower metal-to-metal seal, respectively.

5. An inflatable packer as defined in claim 4, further comprising:

an annular upper elastomeric seal for sealing between the valve collar and the packer body; and a lower annular elastomeric seal for sealing between the valve collar and the packer body.

6. An inflatable packer as defined in claim 5, further comprising:

at least one large through port for establishing communication between a throughbore in the work string and the annular passageway;

the upper elastomeric seal being spaced axially between the at least one through port and the upper metal-to-metal seal when the valve collar is closed; and the lower elastomeric seal being spaced axially between the at least one through port and the lower metal-to-metal seal when the valve collar is closed.

7. An inflatable packer as defined in claim 2, further comprising:

at least one through port extending from the throughbore to the annular passageway, the at least one through port having a cross-sectional flow area of at least 0.15 square inches.

8. An inflatable packer as defined in claim 1, wherein the valve collar is axially moveable by the actuating tool on the work string from the open position to the closed position.

9. An inflatable packer as defined in claim 8, wherein the stop surface on the valve collar is positioned partly about a circumference of the valve collar, such that the actuating tool may selectably engage the stop surface at one circumferential position and disengage the stop surface at another circumferential position to allow the actuating tool to pass through the throughbore in the packer body.

10. An inflatable packer as defined in claim 1, wherein the stop surface is on a radially inward surface of the valve collar; and the seal is carried on the valve collar.

11. A method of setting an inflatable packer positioned along a tubular string in a wellbore, the inflatable packer including a sleeve-shaped packer body having a throughbore therein and an elastomeric packer element radially outward of the packer body, the elastomeric packer element and the sleeve-shaped packer body defining an inflation chamber radially therebetween, the method comprising:

securing an actuating tool along a work string;

lowering the actuating tool and the work string through the tubular string;

mechanically engaging the actuating tool and a valve collar supported on the packer body;

manipulating the work string to selectively open the valve collar;

transmitting an inflation fluid through the open valve collar and to the inflation chamber to inflate the packer element; and mechanically manipulating the work string to selectively close the valve collar and seal the inflation chamber from the wellbore.

12. The method as defined in claim 11, further comprising:

sealing the actuating tool with the packer body; and thereafter transmitting the inflation fluid through the work string and then through a flow passageway in the packer body to inflate the packer element.

13. The method as defined in claim 12, further comprising:

after inflating the packer element, circulating fluid down an annulus exterior of the work string to reverse circulate the inflation fluid up the work string.

14. The method as defined in claim 12, further comprising:

providing an inlet port in the packer body having a cross-sectional flow area of at least 0.15 square inches; and pumping a cementatious fluid through the work string through the inlet port to inflate the packer element.

15. The method as defined in claim 14, further comprising:

providing an annular passageway from the inlet port to the inflation chamber for transmitting the cementatious fluid to the inflation chamber.

16. The method as defined in claim 11, wherein manipulating the work string to sealingly close the valve collar includes making up a metal-to-metal seal between the valve collar and the packer body.

17. The method as defined in claim 16, further comprising:

forming an inner tapered surface on the packer body for metal-to-metal sealing engagement with the valve collar.

18. The method as defined in claim 17, further comprising:

providing an elastomeric seal between the valve collar and the packer body.

19. The method as defined in claim 18, further comprising:

providing at least one inlet port in the packer body for transmitting inflation fluid from an interior of the work string to the inflation chamber; and positioning the elastomeric seal radially between the at least one inlet port and the metal-to-metal seal.

20. The method as defined in claim 11, wherein moving the work string to selectively open the valve collar comprises moving the work string axially within the wellbore to axially move the valve collar with respect to the packer body to the open position.

21. The method as defined in claim 11, further comprising:

subsequent to manipulating the work string to sealingly close the valve collar, thereafter moving the valve collar at least partially toward an open position, and thereafter again moving the valve collar to the closed position.

* * * * *